US005819997A

United States Patent [19]

Mathis et al.

[11] Patent Number: 5,819,997

[45] Date of Patent: Oct. 13, 1998

[54] ACCESSORY FOR BOOT

[76] Inventors: Ronald J. Mathis, 22 Alice Ct., E. Rockaway, N.Y. 11518; James Mark Mathis, 17 Yale Pl., Lynbrook, N.Y. 11563; James Mathis, 4663 Troop K. Rd., Manlius, N.Y. 13104

[21] Appl. No.: 541,375

[22] Filed: Oct. 10, 1995

Related U.S. Application Data

[63] Continuation-in-part of Ser. No. 97,065, Jul. 23, 1993, Pat. No. 5,456,393.

[51] Int. Cl.[6] ..... A45F 5/00

[52] U.S. Cl. ..... 224/148.4; 224/148.7; 224/148.1

[58] Field of Search ..... 224/148.4, 148.7, 224/148.1, 148.2, 148.3, 148.5, 148.6, 269, 666

[56] References Cited

U.S. PATENT DOCUMENTS

| | | | |
|---|---|---|---|
| 1,445,642 | 2/1923 | O'Neill | 224/148.7 |
| 4,363,432 | 12/1982 | Warthen | 224/666 |
| 4,979,707 | 12/1990 | McErlean | 224/148.4 |
| 5,249,702 | 10/1993 | Topp et al. | 224/148.7 |
| 5,398,948 | 3/1995 | Mathis | 224/148.4 |

*Primary Examiner*—David J. Walczak
*Attorney, Agent, or Firm*—Harris Beach & Wilcox, LLP

[57] ABSTRACT

An in-line roller skate that includes a boot having a sole plate to which an in-line roller wheel system is attached and further including a shell and a collar mounted for articulation on the boot for securing the boot to the leg and foot, a U-shaped clamping member having a front plate and an arcuate shaped back plate that conforms to the shape of the boot collar, the plates being cojoined by a base member wherein the plates are biased towards each other, the clamping member removably secured to the boot collar by passing over the boot collar at the spine with the back plate placed inside the collar wherein the back plate extends downwardly along the length of the collar to a depth that brings the base member into contact with the collar wherein the base member cooperates with the arcuate shaped back plate to prevent the frame from canting out of parallel with the spine, and the front plate having integral to and extending from it a frame for holding an article.

10 Claims, 4 Drawing Sheets

ACCESSORY FOR BOOT

This application is a continuation-in-part of U.S. Ser. No. 08/097,065 filed Jul. 23, 1993 now issued U.S. Pat. No. 5,456,393.

BACKGROUND OF THE INVENTION

This invention relates to a boot used in sports and in particular to a boot used in sports that is capable of carrying various articles without impeding the wearer's ability to perform the sport.

Heretofore, boots used in many sporting activities, such as skiing, ice skating, roller skating and the like were made of leather or other flaccid material which provided little structure strength. These types of boots, however, have undergone many changes and improvements over the years. Present day boots typically include a hard high strength molded plastic shell upon which an equally hard high strength plastic collar is mounted for articulation. Both the collar and the shell are separable along the front faces thereof and contain overlapping lips running along the line of separation. Adjustable closure devices are used to draw the shell and the collar snugly, but comfortably against the wearer's foot and lower legs that the boot will respond almost instantaneously to any leg movement.

Clothing worn during these types of activities have also undergone a good deal of change during the same period. The clothing has for the most part become tighter fitting and as a consequence, there is little room to carry articles on one's person. In the case of roller skating, bathing attire is mostly worn when skating in warmer weather, again limiting what the skater can reasonably carry.

Carrying articles on one's person while skiing or skating can lead to serious injury in case of a fall. The article can be driven, upon impact with the ground or ice, into the person's body with great force. As a consequence, people tend to leave such articles as car keys, money and the like behind in unsafe places when partaking in these sports. It is not uncommon to find the articles missing upon returning from the activity.

OBJECTS AND SUMMARY OF THE INVENTION

It is an object of the present invention to improve boots worn when skiing, roller skating, ice skating and the like.

It is a further object of the present invention to provide a device for carrying various articles that can be attached to a boot used in sporting activities in such a way that the ability of the wearer is not impaired.

It is another object of the present invention to provide a carrying bracket that can be removably secured to boots used in a sporting activity.

Yet another object of the present invention is to eliminate the need of a person pursuing certain sports activities to carry articles on his or her person.

A still further object of the present invention is to allow a person participating in certain sports to safely carry articles in a manner to avoid injury in case of a fall.

These and other objects of the present invention are attained by an in-line roller skate having a boot with a collar attached for articulation thereon. A frame for supporting an article is attached to an inverted U-shaped clamping member that has a back plate that is cojoined to a front plate by a biasing member. The back plate of the clamping member is passed downwardly inside the boot collar to a predetermined depth and the back plate is passed downwardly outside the collar to clamp the collar therebetween and thus secure the support frame at the back of the boot.

BRIEF DESCRIPTION OF THE DRAWINGS

For a better understanding of these and other objects of the invention, reference will be made to the following detailed description of the invention which is to be read in association with the accompanying drawings, wherein.

DETAILED DESCRIPTION OF THE INVENTION

Figure 1:
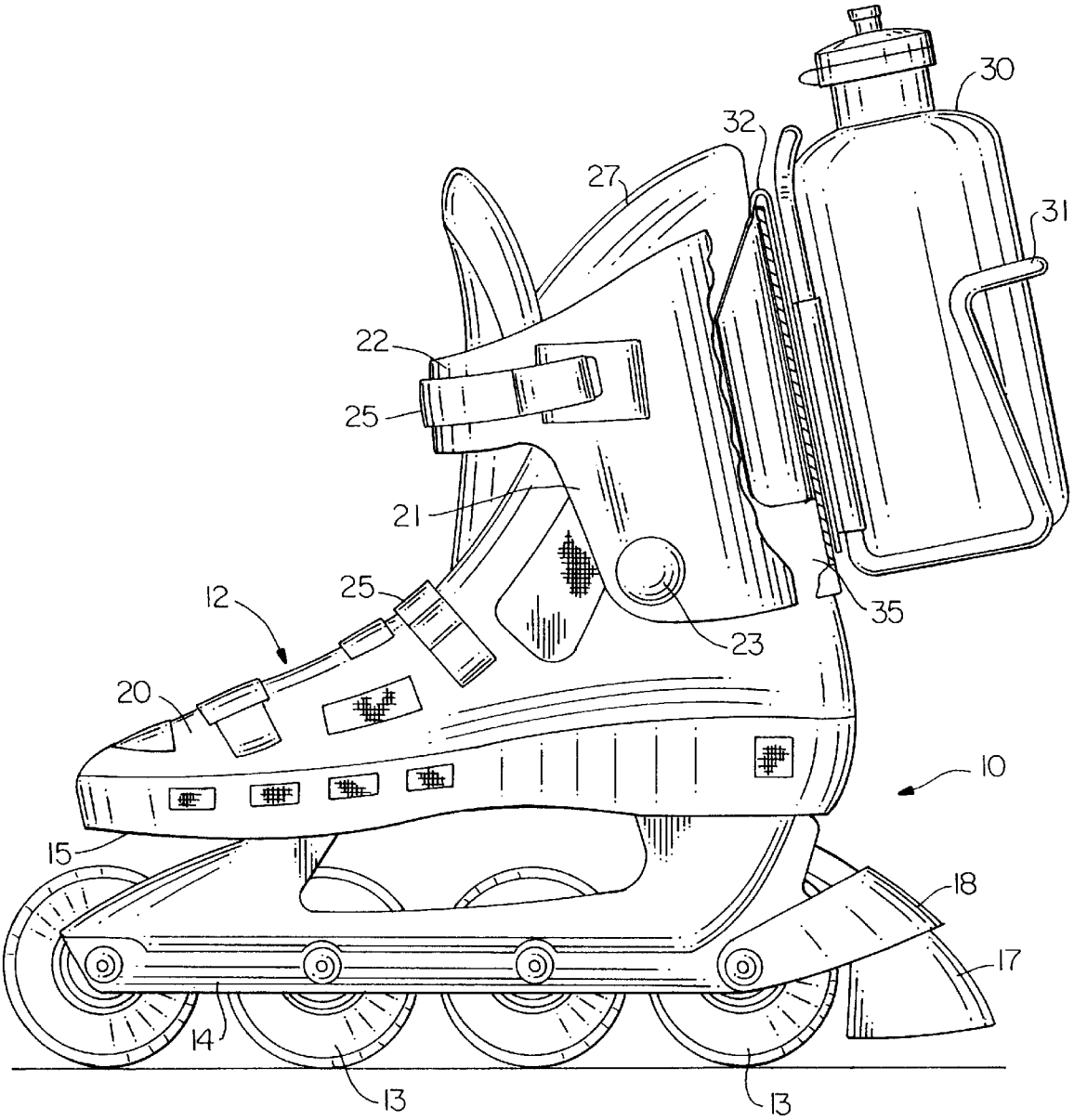
FIG. 1 is a side elevation illustrating a water bottle carrier connected to the back of the boot of an in-line roller skate.

Referring now to FIG. 1, there is shown an in-line roller skate 10 that embodies the teachings of the present invention. The skate includes a boot 12 having a plurality of in-line wheels 13—13 mounted for rotation within a frame 14. The frame, in turn, is affixed to the sole plate 15 of the boot. A brake 17 is attached to the back of the frame by a bracket 18. The boot is of two piece construction that includes a shell 20 and a collar 21 that is mounted on the shell for articulation about a pair of rotors, one of which is shown at 23.

Both the shell and the collar are separated along the front of the boot to permit ease of entry of the wearer's lower leg and foot. Each is provided with buckles 25 that function to close the boot over the wearer's leg and provide a snug fit. A soft liner or insert 27 is contained within the boot which insures a proper comfortable fit.

A water bottle 30 is removably contained within a wire frame 31, which in turn, is clamped to the boot collar by a U-shaped clamping member 32. The clamping member, as will be explained in further detail below is slipped over the collar as shown to support the water bottle along the back or spine 35 of the boot. As can be seen when mounted in this position, the bottle and mounting frame are in a position where they will not interfere with the skater's ability to propel and maneuver the skate during a skating exercise.

Figure 2:
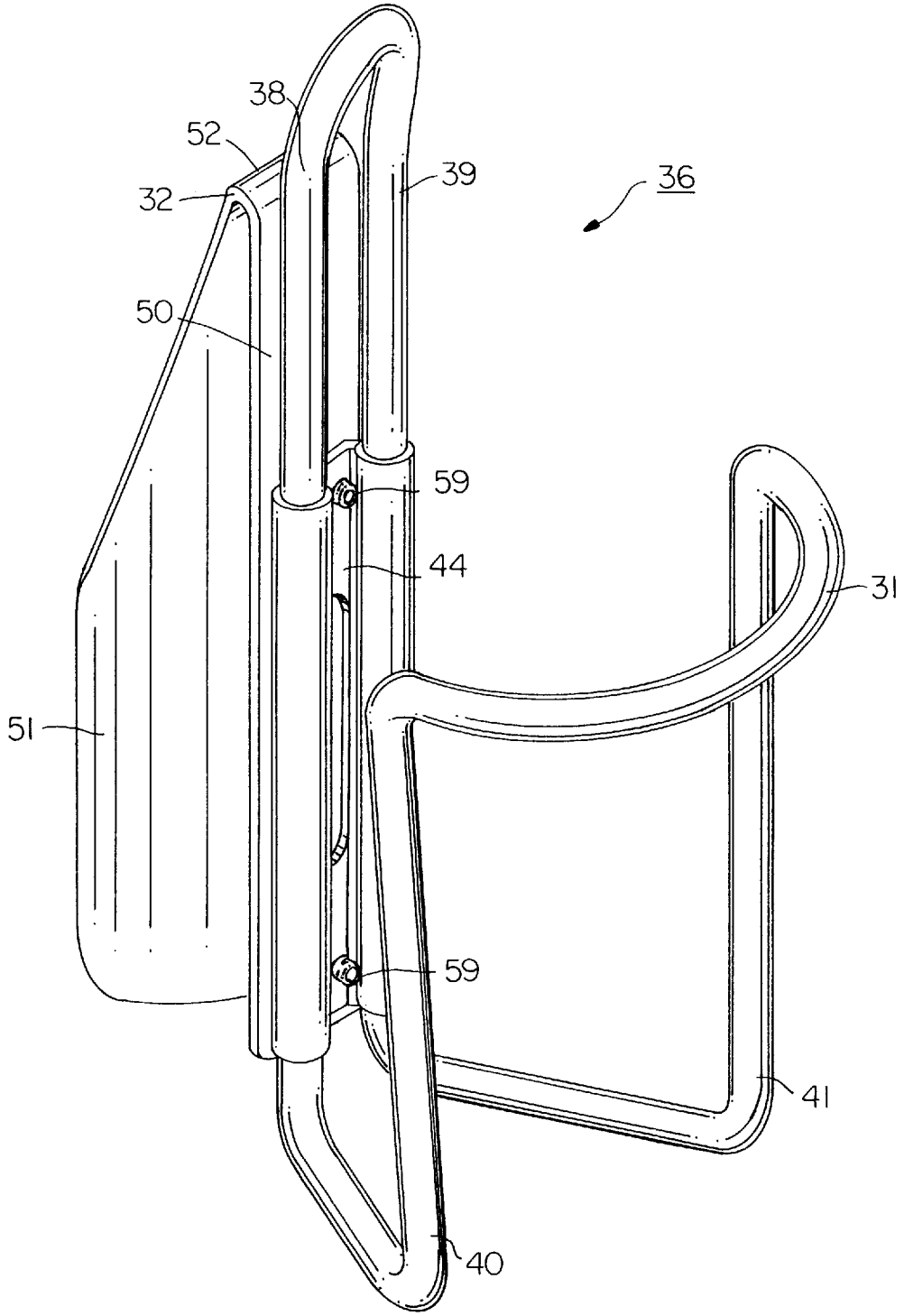
FIG. 2 is an enlarged perspective view of apparatus embodying the teachings of the present invention for supporting a water bottle on the boot of the rollerskate shown in FIG. 1.
Figure 3:
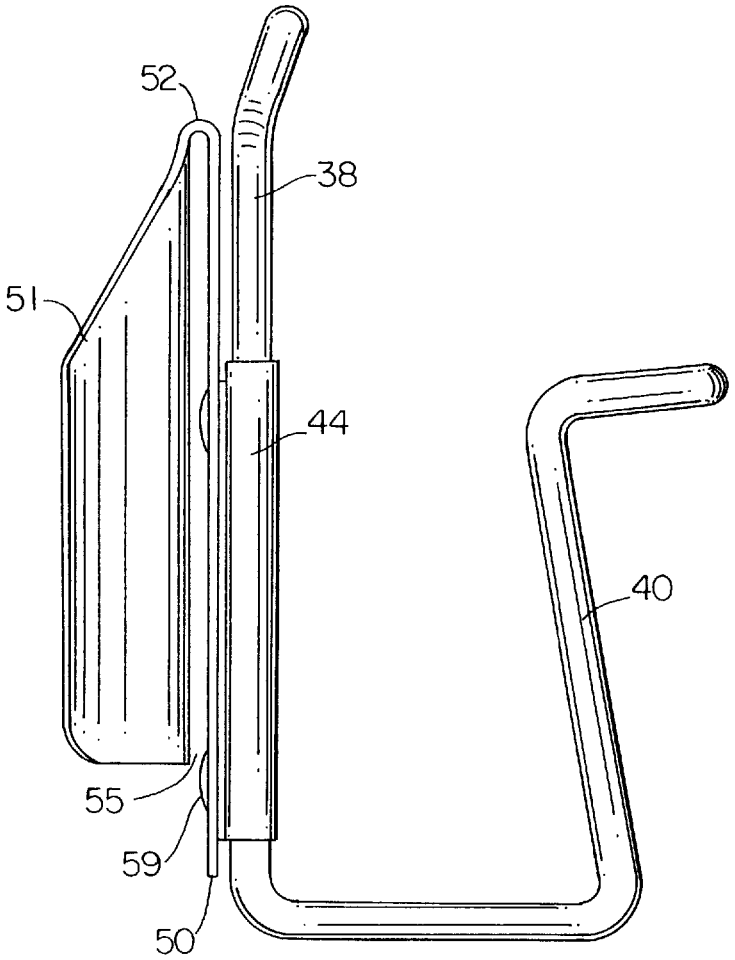
FIG. 3 is a side elevation of the support apparatus shown in FIG. 2.
Figure 4:
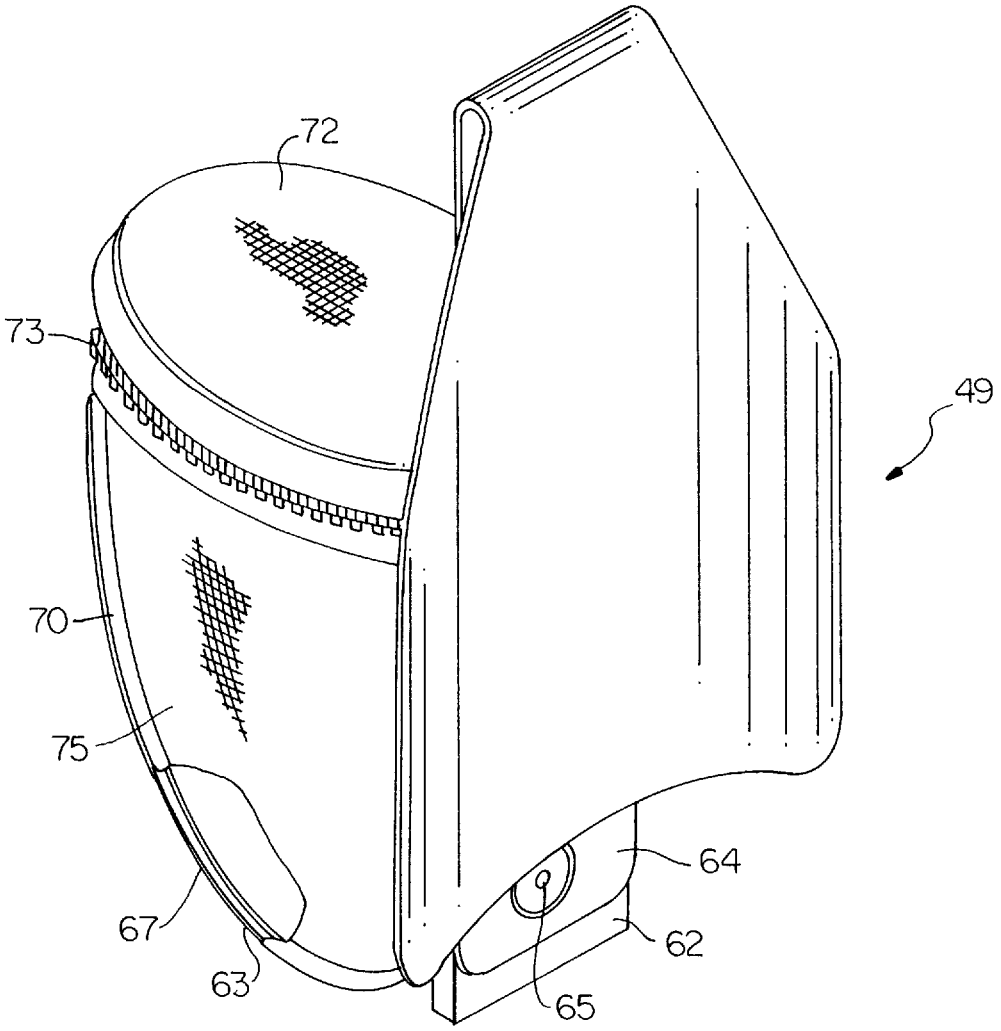
FIG. 4 is a perspective view of a further embodiment of the invention.

Turning now to FIGS. 2–4, there is shown the bottle supporting apparatus generally referenced 36. The apparatus includes a wire frame 37 that is bent to form a basket for holding the bottle therein. The basket includes two back posts 38 and 39 and two foreshortened front posts 40 and 41 between which the bottle can be inserted. The frame, in assembly, exerts a biasing force against the bottle to prevent it from becoming dislodged during a skating exercise.

A U-shaped clamping member 32 is secured to the back posts by means of a vertically disposed support member 44 that is mounted between the two spaced apart back posts. The clamping member is preferably fabricated from a single piece of thin spring steel. However, it can be similarly fabricated of plastic or any other material having sufficient resiliency to provide the required clamping action against the boot as will be explained in greater detail below. The clamping member includes a flat elongated front plate 50 and an opposed elongated back plate 51. The back plate is arcuate in form along its vertical length so that it generally conforms to the shape of the boot collar which, in turn, complements the back of a wearer's leg. Normally, a space 55 is provided between the plates that is somewhat less than the thickness of the collar.

The front plate of the clamping member is attached to the support member of the frame by means of a pair of rivets 59—59. Any other well known fastener, such as screws or the like may be used for this purpose.

In assembly, the clamping member is passed downwardly over the collar with the back plate inside the boot and the front plate outside the boot. The collar being thicker than the space 55 between the plates, forces the plates apart, thus clamping the frame to the boot.

As can be seen, the front plate of the clamping member acts in concert with the arcuate shaped backing plate to hold the frame in an upright position against the boot.

In another embodiment of the invention, the clamping member 49 is attached to a flat support member 62 that is affixed to a wire frame 63. The front plate 64 of the clamping member is attached to the support member by means of fasteners 65 as explained above. The wire frame 63 contains a pair of opposed spaced apart arcuate shaped posts 67 that are secured to the support member so that the posts turn upwardly. An enclosed pouch formed of a fabric material is secured to the frame post by suitable loop connectors 70. The pouch contains a hinged cover 72 that is closed against the body of the pouch by a slide fastener 73.

While this invention has been described with specific reference to an in-line roller skate, it is not limited to this specific application. For example, the need for a support plate can be eliminated by molding the lug as part of the boot or collar. In addition, the apparatus of the present invention can be used in association with other types of boots used in skiing and ice skating activities and is not confined to the details set forth above and this invention is intended to cover any modifications and changes as may come within the scope of the following claims:

We claim:

1. An in-line roller skate that includes:

a boot having a sole plate to which an in-line roller wheel system is attached and further including a shell, with a vertically disposed spine, and a collar mounted for articulation on said boot for securing said boot to a skater's leg and foot, a U-shaped clamping member having a front plate and an arcuate shaped back jaw plate that conforms to the shape of said boot collar, said back plate and said front plate being cojoined by a base member wherein said plates are biased towards each other, said clamping member removably secured to said boot collar by passing said clamping member over said boot collar at said spine with said back plate placed inside said collar wherein said back plate extends downwardly along the length of said collar to a depth that brings said base member into contact with said collar wherein said base member cooperates with said arcuate shaped back plate to prevent said frame from canting from one side or the other of said spine, and said front plate having integral to and extending from it a frame for holding an article.

2. The in-line roller skate of claim 1 wherein said frame is adapted to receive and releasably secure a water bottle.

3. The in-line roller skate of claim 1 wherein said frame is adapted to support an enclosed pouch with a hinged lid formed of a fabric material secured to said frame by loop connectors.

4. The in-line roller skate of claim 3 wherein said pouch further includes means for securing said hinged lid in a closed position against said pouch.

5. An in-line roller skate that includes:

a boot having a sole plate to which an in-line roller wheel system is attached and further including a shell, with a vertically disposed spine, and a collar mounted for articulation on said boot for securing said boot to a skater's leg and foot, a U-shaped clamping member having a front plate and an arcuate shaped back jaw plate that conforms to the shape of said boot collar, said back plate and said front plate being cojoined by a base member wherein said plates are biased towards each other, said clamping member removably secured to said boot collar by passing said clamping member over said boot collar at said spine with said back plate placed inside said collar wherein said back plate extends downwardly along the length of said collar to a depth that brings said base member into contact with said collar wherein said base member cooperates with said arcuate shaped back plate to prevent said frame from canting from one side or the other in regard to said spine, a frame for supporting an article, and fastening means for joining said frame to said front plate.

6. The in-line roller skate of claim 5 wherein said frame is adapted to receive and releasably secure a water bottle.

7. The in-line roller skate of claim 5 wherein said frame is adapted to support an enclosed pouch with a hinged lid formed of a fabric material secured to said frame by loop connectors.

8. The in-line roller skate of claim 7 wherein said pouch further includes means for securing said hinged lid in a closed position against said pouch.

9. A removable bottle holder that is insertable downwardly into the back of a boot along the boot spine that includes a boot engaging member in the form of a U-shaped clamp having an elongated vertically disposed front plate and an opposed vertically disposed back plate that are joined together along their top margins by a horizontally disposed base member for biasing said plates towards one another whereby said clamp can be inserted downwardly along the spine of a boot with the back plate inside the boot and the front plate outside the boot, said back plate being arcuate shaped along its vertical length whereby said back plate conforms to the shape of a boot within the spine region, a support secured to the front plate of the boot engaging member; and a bottle holder attached to said rigid support for removably holding a bottle in a vertical upright position.

10. The article holder of claim 9 wherein said bottle holder is a wire frame.

* * * * *